US011084687B2

(12) United States Patent
Gerstenmeyer et al.

(10) Patent No.: US 11,084,687 B2
(45) Date of Patent: Aug. 10, 2021

(54) METHOD FOR OPERATING A LIFT SYSTEM, AND LIFT SYSTEM

(71) Applicant: thyssenkrupp Elevator Innovation and Operations GmbH, Essen (DE)

(72) Inventors: Stefan Gerstenmeyer, Filderstadt (DE); Markus Jetter, Filderstadt (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 738 days.

(21) Appl. No.: 15/742,716

(22) PCT Filed: Jun. 29, 2016

(86) PCT No.: PCT/EP2016/065150
§ 371 (c)(1),
(2) Date: Jan. 8, 2018

(87) PCT Pub. No.: WO2017/005575
PCT Pub. Date: Jan. 12, 2017

(65) Prior Publication Data

US 2018/0201472 A1 Jul. 19, 2018

(30) Foreign Application Priority Data

Jul. 9, 2015 (DE) ..... 10 2015 212 903.9

(51) Int. Cl.
*B66B 1/24* (2006.01)
*B66B 5/00* (2006.01)
*B66B 9/00* (2006.01)

(52) U.S. Cl.
CPC ..... *B66B 1/2466* (2013.01); *B66B 1/2491* (2013.01); *B66B 5/0031* (2013.01);
(Continued)

(58) Field of Classification Search
CPC ..... B66B 1/2466; B66B 5/0031; B66B 9/003; B66B 1/2491; B66B 2201/103;
(Continued)

(56) References Cited

U.S. PATENT DOCUMENTS 4,004,654 A * 1/1977 Hamy ..... B66B 9/003 198/798
2003/0217893 A1 11/2003 Dunser et al.
(Continued)

FOREIGN PATENT DOCUMENTS

CN 101568482 A 10/2009
EP 1367018 A 12/2003
(Continued)

OTHER PUBLICATIONS

English Translation of International Search Report issued in PCT/EP2016/065150, dated Oct. 4, 2016 (mailed Nov. 2, 2016).

*Primary Examiner* — Jeffrey Donels
(74) *Attorney, Agent, or Firm* — William J. Cassin

(57) ABSTRACT

A method for operating an elevator system having a shaft system and elevator cars that are moved separately between floors in a circulation operation may involve moving the elevator cars upward in a first shaft and moving the elevator cars downward in a second shaft. A number of shaft positions that can be respectively adopted by the elevator cars and that correspond to the number of elevator cars is defined, and synchronization of movement of the elevator cars may be carried out with respect to these defined shaft positions. Further, each of the elevator cars may be moved according to a travel curve. To synchronize the movement of the elevator cars the travel curve for each elevator car may be adapted to account for positions of the elevator cars in the same shaft.

20 Claims, 4 Drawing Sheets

(52) U.S. Cl.
CPC ..... *B66B 9/003* (2013.01); *B66B 2201/103* (2013.01); *B66B 2201/215* (2013.01); *B66B 2201/224* (2013.01)

(58) Field of Classification Search
CPC ..... B66B 2201/215; B66B 2201/224; B66B 1/24; B66B 5/00; B66B 9/00
See application file for complete search history.

(56) References Cited

U.S. PATENT DOCUMENTS

| | | | | |
|---|---|---|---|---|
| 2006/0016640 | A1 | 1/2006 | Duenser et al. | |
| 2010/0065378 | A1 | 3/2010 | Christy | |
| 2017/0233218 | A1* | 8/2017 | Zheng | B66B 1/2466 187/247 |
| 2017/0355553 | A1* | 12/2017 | Steinhauer | B66B 1/3446 |
| 2018/0237257 | A1* | 8/2018 | Gerstenmeyer | B66B 9/003 |
| 2018/0334360 | A1* | 11/2018 | Steinhauer | B66B 5/0087 |

FOREIGN PATENT DOCUMENTS

| | | | |
|---|---|---|---|
| EP | 1619157 | A | 1/2006 |
| JP | 03023171 | A | 1/1991 |
| JP | 04191251 | A | 9/1992 |
| JP | 05039173 | A | 2/1993 |
| JP | H0597353 | A | 4/1993 |
| JP | 06271214 | A | 9/1994 |
| JP | 06305648 | A | 11/1994 |
| JP | 07277613 | A | 10/1995 |
| JP | 3404440 | B2 | 10/1996 |
| JP | H08282926 | A | 10/1996 |

* cited by examiner

METHOD FOR OPERATING A LIFT SYSTEM, AND LIFT SYSTEM

CROSS REFERENCE TO RELATED APPLICATIONS

This application is a U.S. National Stage Entry of International Patent Application Serial Number PCT/EP2016/065150, filed Jun. 29, 2016, which claims priority to German Patent Application No. DE 10 2015 212 903.9, filed Jul. 9, 2015, the entire contents of both of which are incorporated herein by reference.

FIELD

The present disclosure generally relates to elevator systems, including elevator systems that have a shaft system with multiple elevator cars that can move in a circulation operation.

BACKGROUND

High rise buildings and buildings with a large number of floors require complex elevator systems in order to be able to overcome all the transportation processes as efficiently as possible. In particular, at peak times a large number of persons may wish to be transported from the ground floor of a building to the different floors of this building. At further peak times, there is, for example, a need to convey a large number of persons from the different floors to the ground floor.

Elevator systems for such purposes are known, in particular what are also referred to as multi-car systems, which are an elevator system having a multiplicity of cars which can be moved separately from one another, that is to say largely independently of one another, in a shaft system. Methods for operating such an elevator system which are known in the prior art provide, inter alia, what is referred to as a circulation mode in this context. That is to say, as in the case of a paternoster, the elevator cars are moved upward in one shaft and downward in another shaft. However, since in modern multi-car systems which are operated in a circulation operation the elevator cars are to be moved separately from one another, in particular in order to be able to convey a relatively large number of persons more quickly to a desired floor and in order to implement short waiting times for the users, the problem arises of moving the elevator cars suitably.

Traffic jams may thus occur in multi-car systems which are operated in a circulation operation. This is because a plurality of cars are moved in the same shaft and in doing so cannot move past one another. Since the elevator cars have to stop for different lengths of time at stopping points, in particular conditioned by the number of persons getting in and/or getting out at the respective stopping point, and therefore the elevator cars have different stopping times, without suitable counter-measures subsequent elevator cars will or can run up against an elevator car traveling ahead. In such a case, such a traffic jam generally disperses again at the most slowly and gives rise to longer waiting times for the persons to be conveyed as well as to delay times during the further transportation of cars occupied by persons. In this context, relatively long waiting times and delays can be experienced by persons as being particularly irritating and uncomfortable.

Furthermore, such a traffic jam amplifies what is referred to as the bunching effect. This is because the elevator car traveling ahead is fully laden with waiting passengers. There are fewer passengers waiting for the elevator car which follows just after this. The stopping time of this elevator car is as a result shorter, which causes this car to be "held up" further by the car traveling ahead.

A further problem in multi-car systems operated in the circulation operation is the occurrence of energy peaks, in particular in multi-car systems in which the elevator cars are operated with linear motors. Since these last-mentioned multi-car systems do not have any cables or counterweights, all of the energy has to be introduced by the linear motor for the acceleration of the elevator car which is to be moved upward. If, for example, a plurality of elevator cars is to be moved upward at the same time, without further elevator cars having to be moved downward, then a very large energy demand and very high power consumption from the power system feeding multi-car system are necessary.

DETAILED DESCRIPTION

Figure 1:
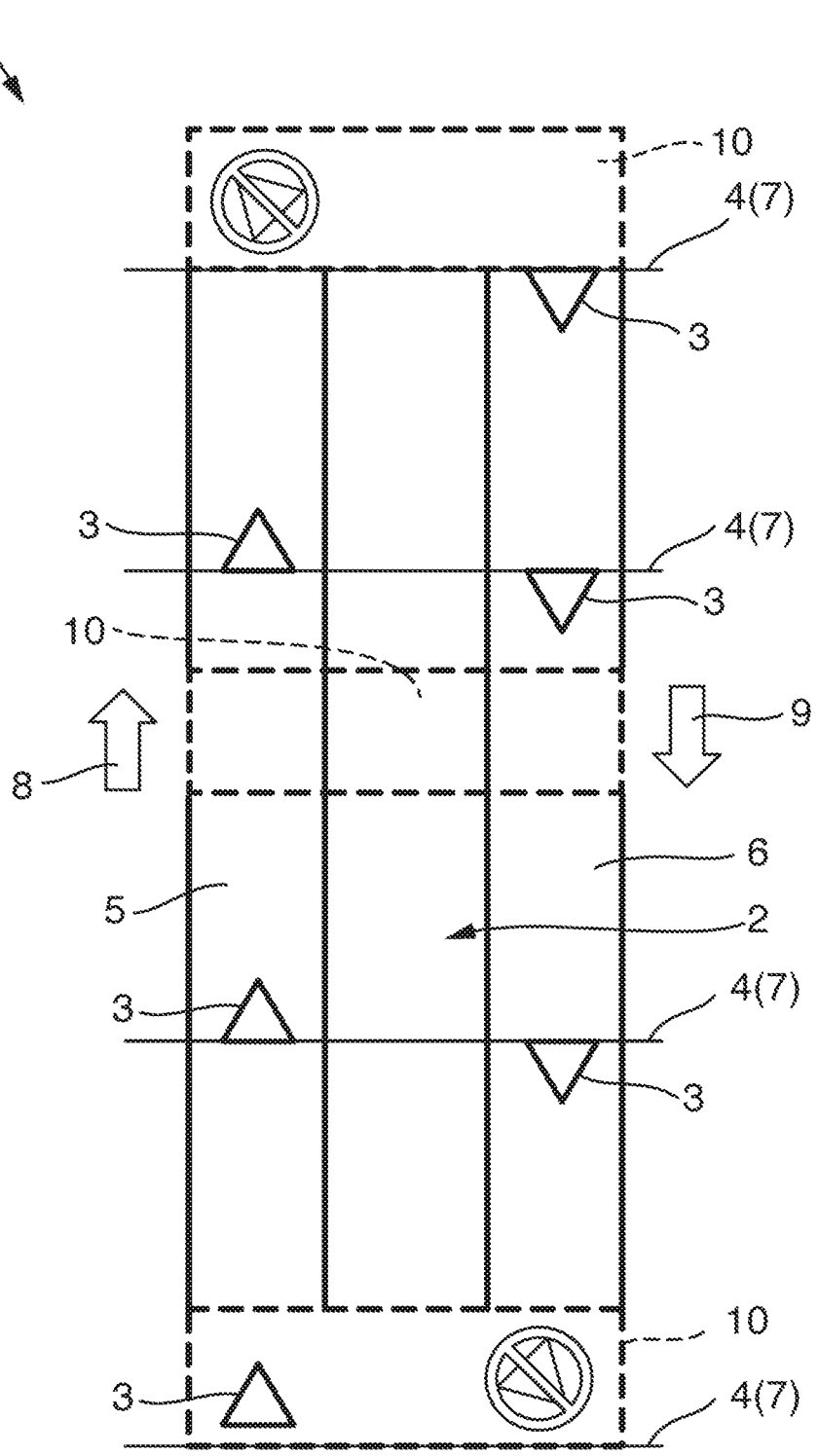
FIG. 1 is a simplified schematic view of an example elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to methods for operating elevator systems that have a shaft system and a multiplicity of elevator cars. The elevator cars may be moved separately from one another here between floors in a circulation operation. The elevator cars may move here in such a way that the elevator cars move upward in a first shaft and move downward in a second shaft. In addition, the present disclosure generally relates to elevator systems that have a shaft system, a plurality of elevator cars that can move in the shaft system, and a control device for operating the elevator system.

One example object of the present disclosure is to improve a method for operating an elevator system having a shaft system and a multiplicity of elevator cars which are moved separately from one another between floors in a circulation operation in such a way that the elevator are moved upward in a first shaft and are moved downward in a second area. The method is intended to be improved, in particular, to the effect that the formation of traffic jams is avoided as far as possible. Waiting times for persons using the elevator system are also to be advantageously kept as short as possible. In addition, an elevator system which is improved with respect to operation is to be made available.

In some examples, a method for operating an elevator system may comprise a shaft system and a multiplicity of elevator cars. The elevator cars may be moved here separately from one another between floors in a circulation operation. Moved separately from one another means here, in particular, that elevator cars can be moved simultaneously at different speeds; in particular, it may also be the case that some elevator cars are not moved while other elevator cars are moved. The elevator cars may be moved in the circulation operation in such a way that the elevator cars are moved upward in a first shaft and are moved downward in a second shaft. The first shaft and the second shaft can also each be areas of a shaft in this context. In particular, as one refinement variant there is also provision that the elevator cars are moved upward in a plurality of shafts and are moved downward in a plurality of further shafts. According to the present disclosure, there is also provision that synchronization of the movement of the elevator cars is carried out with respect to defined shaft positions which can be respectively adopted by the elevator cars, wherein the number of the defined shaft positions corresponds at least to the number of elevator cars. As a result of this synchronization, advantageously a minimum distance, particularly advantageously a minimum time interval, may be maintained between two elevator cars. A movement of the individual elevator cars is therefore advantageously carried out with respect to specific shaft positions taking into account the totality of the further elevator cars. During the synchronization of the elevator cars, in this context at least one action which relates to the movement of the elevator cars and advantageously changes the elevator system into a predetermined or predeterminable state is advantageously executed here with respect to the shaft positions. In particular, as a possible embodiment variant there is provision that the synchronization moves the elevator cars into defined positions, similar to what is referred to as a "reset". As a result, it is advantageously possible to ensure that a minimum time interval is maintained between the elevator cars.

The elevator cars do not necessarily have to stop or be located at the defined shaft positions here. Instead, at the shaft positions the elevator cars can be in different operating phases, for example in a deceleration phase or an acceleration phase or a stopping phase.

Individual elevator cars or relatively small groups of elevator cars, in particular groups of elevator cars comprising three or four elevator cars, can advantageously be excluded from the synchronization. Such an advantageous refinement is provided, in particular, for elevator systems in what are referred to as the "High Rise" field, in particular when these individual elevator cars are not moved, for example owing to the lack of a call request, and the distance from following elevator cars significantly exceeds a safety distance which is to be maintained between elevator cars. The safety distance is clearly exceeded in particular when at least one free stopping point lies between an elevator car and the elevator car which is following this elevator car.

One advantageous refinement of the method provides that the shaft positions are defined once. This one-off definition is carried out preferably before the first movement of the elevator cars. If the elevator system is put out of operation, for example the elevator system is switched off at night, there is provision according to one refinement variant that the shaft positions are defined again before the elevator system is put into operation again. The one-off definition of shaft positions has the advantage here that the control unit of the elevator system, which control unit controls the execution of the synchronization of the movement of the elevator cars with respect to the defined shaft positions, can be made simpler.

On the other hand, a further advantageous refinement of the method according to the invention provides that the shaft positions with respect to which the synchronization of the movement of the elevator cars is carried out are newly defined in each case after the occurrence of at least one predefined event. As a result, the movement can advantageously be dynamically adapted to changed operating conditions of the elevator system. In particular, there is provision here that the feeding of elevator cars into the circulation operation and/or removal of elevator cars from said circulation operation is such a predefined event. When elevator cars are fed in, in this context additional elevator cars were introduced for movement in the shaft system of the elevator system, for example via a storage shaft, into which elevator cars can be removed from circulation and, as it were, parked at times of low use of the elevator system. Such a predefined event is preferably the expiry of a predefined time interval, with the result that, for example, every ten seconds the shaft positions with respect to which the synchronization is to be carried out are redefined. According to this refinement, the shaft positions can therefore advantageously be defined in a time-dependent fashion. Further predefined events are advantageously previously detected possible operational disruptions and/or the exceeding of predictive stopping times when an elevator car stops at a stopping point.

In particular, the invention provides that the synchronization of the movement of the elevator cars is carried out in such a way that at the defined shaft positions the elevator cars are each operated in the same operating state. Operating states of an elevator car are here, in particular, braking of an elevator car or acceleration of an elevator car or stopping of an elevator car.

According to a further advantageous refinement of the method according to the invention there is provision that the elevator cars are each moved according to a travel curve. In order to synchronize the movement of the elevator cars, the respective travel curves are advantageously adapted here, in particular taking into account at least one operating parameter of the elevator system, preferably at least taking into account the positions of the elevator cars in the respective shaft. In particular there is provision that for each elevator car a travel curve which is adapted to this elevator car is generated. The travel curves of the elevator cars are advantageously generated on the basis of input values. These input values comprise here, in particular, a speed to be reached by the elevator car, the acceleration or deceleration of this elevator car, and what is referred to as the jolt, that is to say a change in the acceleration or the deceleration over time. In particular a change in the jolt is provided as a further input value. Different travel curves for the respective elevator cars and/or adaptation of the input values for their travel curve, which is carried out with respect to the respective elevator car, are advantageously used for the synchronization and for permitting individual stopping times of the elevator cars, in particular of individual stopping times at the stopping points. The adaptation of the travel curves of the elevator cars for the synchronization of the elevator cars is advantageously carried out here before the travel of an elevator car and also during the travel of an elevator car. However, there is in particular also provision that the adaptation of the travel curve takes place before the travel of an elevator car or during the travel of an elevator car.

Adaptations of the travel curves of the elevator cars are also carried out, in particular, on the basis of different vertical distances between the stopping points lying ahead. This is because the different vertical distances result in different arrival times when the input values of the travel curve are the same. In order, for example, to obtain arrival times which are synchronized in the case of synchronized starts, the input values of the travel curves of the individual elevator cars are advantageously coordinated with one another such that a simultaneous arrival of the elevator cars at the next stop is brought about.

A further advantageous refinement of the method according to the invention provides that stopping points of the elevator system are defined as the shaft positions. In this case, use is advantageously made of the fact that during normal operation of the elevator system, that is to say when there is no disruption of the elevator system, the elevator cars usually stop only in stopping points, in particular in order to avoid irritating the passengers. So that the times of departure of an elevator car from a stopping point until the arrival of the next elevator car at this stopping point are adapted as well as possible to the requirements of use of the elevator system, and in particular long waiting times are avoided when there is high passenger traffic, it is particularly advantageous to define stopping points as the shaft positions with respect to which the synchronization is carried out. In particular for the explicitly provided operation of the elevator system in which fewer elevator cars are moved in the shaft system than there are stopping points, a subset of stopping points is advantageously determined, wherein only the stopping points of this subset are defined as shaft positions. This determination is advantageously carried out in a situation-dependent fashion, in particular as a function of the occurrence of at least one predefined event. In this context, in particular the current positions of the elevator cars are provided as predefined events.

Advantageously, in the method according to the invention, in each case one of the defined shaft positions is logically assigned to one of the elevator cars in each case. Therefore, in particular for each of the elevator cars there is advantageously a clear definition of the shaft position with respect to which the synchronization of the method of this elevator car is carried out.

According to a further advantageous aspect there is provision that in each case the shaft position which is defined as the next to be reached in the direction of travel of an elevator car is logically assigned to the respective elevator car. According to one advantageous refinement, this shaft position is in this context the stopping point which is to be traveled to next by the elevator car. As a result of the fact that according to this advantageous refinement the respective defined shaft position which is the next to be reached by the elevator car is logically assigned to the respective elevator car, good predictability of the elevator system is advantageously implemented. Furthermore, it is advantageously possible to react quickly to the occurrence of unforeseen events such as an operational fault.

According to a further advantageous refinement of the method according to the invention there is provision that at defined time intervals in each case current positions of the elevator cars in the respective shaft are defined as the shaft positions. In this refinement, in each case one elevator car is advantageously logically linked to the current position of the elevator car traveling ahead of this elevator car. In this context, the synchronization of the movement of the elevator cars is preferably carried out in each case with respect to the shaft positions which are logically linked to the respective elevator cars. The time intervals can advantageously be adapted to the passenger volume to be conveyed. The number of elevator cars used in the elevator system can also advantageously be adapted to the passenger volume to be conveyed. By means of these refinements, a current traffic volume is advantageously taken into account in an improved way and adapted in an improved way to an increased transportation demand. In particular, a time interval between 5 seconds and 120 seconds is provided as a time interval. The greater the number of elevator cars which are moved per shaft section, the shorter the time interval which is preferably selected here.

According to a further advantageous refinement of the invention, the synchronization of the movement of the elevator cars is carried out with respect to the defined shaft positions in such a way that all the elevator cars reach the defined shaft positions simultaneously. In particular, there is provision here that stopping points of the elevator system are defined as the shaft positions. The movement of the elevator cars is advantageously synchronized here in such a way that all the elevator cars which are involved in the synchronization and which are moved in the shafts of the shaft system reach simultaneously the shaft positions defined by the stopping points. In this refinement, all the elevator cars involved in the synchronization therefore advantageously move simultaneously into the respective stopping point which defines a shaft position. Therefore, an arrival synchronization is carried out with respect to the reaching of a stopping point. In this context, the travel curves are advantageously changed, by adapting the input values, in such a way that the elevator cars arrive simultaneously at their next stopping point. In particular there is provision that after the respective stopping times of the elevator cars, which can each be of different lengths for said elevator cars, they are moved on individually. That is to say the respective stopping points are exited independently of one another in this refinement. The arrival time which is common to the elevator cars at a respective defined shaft position, in particular at a stopping point as a defined shaft position is advantageously used here to determine suitable input parameters or operating parameters for the travel curve. In this context, anticipated stopping times and/or anticipated residual stopping times of the individual elevator cars are advantageously taken into account.

Additionally or alternatively to this there is provision, as a further advantageous refinement of the method according to the invention, that the synchronization of the movement of the elevator cars is carried out with respect to the defined shaft positions in such a way that all the elevator cars which are involved in the synchronization leave the defined shaft positions simultaneously. In this context, stopping points of the elevator system are advantageously defined as the shaft positions with respect to which the synchronization is carried out. Therefore, as it were, a starting synchronization of the elevator cars is carried out with respect to the exiting of the respective defined shaft positions, in particular with respect to the exiting of the stopping points as defined shaft positions. There is advantageously provision that in the case of a predicted stopping time of an elevator car which is significantly shorter than the predicted stopping times of the other elevator cars, the arrival of this elevator car at the next defined shaft position, in particular the next stopping point, is delayed by adapting the travel curve of this elevator car. This can be carried out, in particular, during the movement of this elevator car to the stopping point, but in particular also before the movement of the elevator car. By virtue of the later arrival which can be achieved by this means and the short stopping time it is advantageously possible to implement a synchronized start of the elevator cars during the further movement of the elevator cars, with the advantage that no additional stopping points are produced in the process.

One advantageous development of the method according to the invention provides that the synchronization of the movement of the elevator cars is carried out with respect to the defined shaft positions in such a way that in each case a duration, that is to say a time interval, is predefined, wherein in the respective shaft the elevator cars do not reach the shaft position of the elevator car which is traveling ahead until after the expiry of this duration. The precise duration advantageously represents here a minimum time interval between the elevator cars. The synchronization is advantageously carried out here by correspondingly adapting the travel curves of the elevator cars, in particular by adapting the travel curves before the departure after an elevator car has stopped and/or during the movement of an elevator car.

If stopping points are defined as shaft positions with respect to which the synchronization is carried out, this development of the method according to the invention provides, in particular, that after an elevator car has moved into a stopping point, the following elevator car moves into this stopping point at the earliest after the expiry of the predefined time interval. In particular, there is additionally provision that the synchronization of the movement of the elevator car is carried out in such a way that the elevator cars reach the respectively defined shaft positions precisely at the expiry of the predefined time interval.

Here and/or in another refinement of the invention, further method steps are preferably provided which ensure that the shaft position which is to be respectively reached by an elevator car is not occupied by a further elevator car. There is provision as such method steps, in particular, that the doors of the elevator cars are closed either after a permanently predefined time interval or preferably after a time interval which is adapted to the synchronization or a time interval which is predefined by the synchronization. In this context, there is provision as a refinement variant that the doors firstly close to half of the passage width. This advantageously prevents further persons from entering and does not further delay further movement of the elevator car.

In order to reduce irritation for persons to be conveyed, the movement of the elevator cars and/or the synchronization of the elevator cars which takes place are/is indicated acoustically and/or displayed visually to the persons to be conveyed and/or the conveyed persons. In particular, there is provision in this respect that a time and/or a countdown until the doors of an elevator car close and/or until an elevator car moves into a stopping point and/or until an elevator car leaves a stopping point are/is displayed.

Such a display is advantageously provided here in the elevator car and/or outside the elevator car, in particular outside the elevator car in the entry region or exit region of a stopping point. Furthermore, entry information is advantageously made available to the user at the floors. This entry information advantageously comprises not only the above-mentioned times but also a signaling device, in particular a traffic light as a signaling device which regulates the entry process.

A display which is provided according to a further advantageous refinement and which indicates how many passengers can still enter, or are still permitted to enter, the elevator car, advantageously contributes to a further improved orientation of the users of the elevator system. In particular, this advantageously increases the readiness of persons to be conveyed to wait for the next car. A capacity display, which provides information as to how many persons can enter an elevator car is advantageously provided before the elevator car arrives and before the door of the elevator car opens. However, this capacity display is advantageously also provided during the entry process and is correspondingly updated in this context.

There is provision as a further advantageous refinement variant or development of the method according to the invention that the synchronization of the movement of the elevator cars is carried out with respect to the defined shaft positions in such a way that, for an operating time period of the elevator system the elevator cars each reach the respective defined shaft positions at a predefined time. As a result of this advantageous synchronization, a movement of the elevator cars is advantageously carried out, as it were, according to a timetable. That is to say it is possible, for example for an entire day, to define the time at which a particular elevator car will reach a particular shaft position. In order to carry out adaptation to a relatively long stop by one or more elevator cars, there is provision here, in particular, for the predefined times to be adapted within the scope of the synchronization, preferably in such a way that the predefined times are adapted by a specific time interval. If, for example, a predefined time for reaching a specific shaft position is 10:12:30 hours for an elevator car, in the case of a delay of a stopping process of an individual elevator car this time can have a time interval of 30 seconds applied to it within the scope of the synchronization, with the result that the new time is 10:13:00 hours.

According to a further advantageous refinement of the invention, the synchronization of the movement of the elevator cars is carried out with respect to the defined shaft positions in such a way that, for an operating time period of the elevator system, the elevator cars each leave the respective defined shaft positions at a predefined time. By virtue of this advantageous synchronization, a movement of the elevator cars is also advantageously carried out, as it were, according to a timetable, wherein, in particular the time at which the elevator cars respectively leave the stopping points as defined shaft positions is predefined here. That is to say it is possible to define, for example for an entire day, the time at which a particular car leaves a particular shaft position, in particular a certain stopping point. In order to carry out adaptation to a relatively long stop of one or more elevator cars, there is provision here, in particular, for the predefined times to be adapted within the scope of the synchronization, preferably in such a way that the predefined times are adapted by a specific time interval. If, for example a predefined time for leaving a specific shaft position for an elevator car is 08:22:00 hours, in the case of a delay of a stopping process of an individual elevator car this time can have a time interval of 45 seconds added to it within the scope of the synchronization, with the result that the new time is 8:22:45 hours.

A further advantageous refinement provides that the synchronization of the movement of the elevator cars is carried out with respect to the defined shaft positions in such a way that in each case a duration is predefined for an operating time period of the elevator system, wherein in the respective shaft the elevator cars do not reach the shaft position of the elevator car which is respectively traveling ahead until after the expiry of this duration. The precise duration advantageously represents here a minimum time interval between the elevator cars. In operating time periods with a high traffic volume, in particular in the morning and/or at midday, the minimum time interval is advantageously the shortest, with the result that short waiting times for elevator cars are implemented for the users.

Operating parameters are advantageously acquired with respect to each of the elevator cars. Each of the elevator cars is moved here preferably at least taking into account the operating parameters acquired for this elevator car and taking into account the operating parameters acquired for the elevator car traveling ahead of this elevator car. Such operating parameters are for an elevator car, in particular, the current position and/or the current speed and/or the current acceleration or deceleration and/or a currently determined waiting time for a stopping process. In particular, there is provision that during the synchronization safety distances which are always to be maintained are taken into account between successive elevator cars, with the result that the safety distance between elevator cars is not undershot at any time during the operation of the elevator system.

According to a further particularly advantageous refinement of the invention, stopping times during which the respective car is not moved are predicted for each of the elevator cars, and these predicted stopping times are each acquired as one of the operating parameters. Anticipated stopping times of an elevator car are predicted here, in particular, while taking into account the load of the elevator car. The load advantageously permits conclusions to be drawn here about the number of persons in the elevator car. In particular there is also provision that the number of persons in the elevator cars is respectively detected and taken into account during the prediction of the stopping times of the elevator cars, particularly preferably further taking into account call entries, in particular destination call entries, which are made by the persons. This advantageously makes it possible to estimate even better how many persons will enter and/or get out at a stopping point and in this respect how long the stopping time at the stopping point will last. The number of waiting passengers at a stopping point is advantageously estimated here by means of destination call detection systems and/or by means of monitoring systems such as, in particular, cameras systems. In particular, there is additionally provision that times of day and traffic flows which are usually associated with these times of day are taken into account for the prediction of stopping times. In this context, a traffic flow is preferably learnt, and this learnt traffic flow is also taken into account during the prediction of stopping times. In particular stochastic methods are used during the prediction of stopping times.

Since the stationary times of the individual elevator cars can in some cases differ greatly, synchronization of the start or arrival of the car with respect to a stopping point is particularly advantageous, since as a result the synchronization can be maintained without further measures.

In a further advantageous refinement of the invention, the elevator system has at least one transfer device for transferring elevator cars between shafts of the elevator system, wherein the at least one transfer device is defined as a shaft position for an elevator car which is transferred by said transfer device. Such transfer devices can be provided at the start and at the end of shafts in order to transfer the elevator cars from one shaft into the other. Transfer devices arranged between the start and the end of shafts have the advantage that for a change in direction of travel of an elevator car the elevator car does not have to travel through the entire shaft.

Stopping points with transfer devices between two shafts can have an access, in particular, in each shaft. By virtue of a shorter distance to be traveled between two shafts and owing to the mechanical design of the transfer system it is advantageous to provide a special handling system in the synchronization process for elevator cars in the horizontal movement in the transfer system and/or for elevator cars which move into a transfer system. In particular, adaptation of the input values for the travel curve of an elevator car is provided if a transfer device is only able to "allow an elevator car to move in" with a delay. Owing to structural restrictions of the transfer system with respect to the horizontal movement of an elevator car, the horizontal movement in the transfer system is advantageously adapted to the synchronization of the elevator cars which are to be moved vertically. In particular there is provision here for a transfer system to consider "outward" as a defined shaft position with respect to the method according to the invention, in which shaft position two or more cars can be located in the case of an "internal" consideration. If, according to a further refinement variant, the transfer system is arranged underneath a main stopping point, for example a stopping point underneath the main stopping point, or if a plurality of access stopping points are provided, the entire area can, in particular, also be located underneath the main access level part of this special handling system.

A further refinement of the invention therefore provides that at least one sub-area of the shaft system in which a subset of the elevator cars of the elevator system is located is excluded from the execution of the synchronization. This advantageously provides the possibility of carrying out the synchronization for every second or every third stopping point. This therefore results in a sub-area between these stopping points with respect to which synchronization is carried out. In particular synchronization which is independent of the rest of the shaft system can be carried out within this sub-area, in particular synchronization after one or more of the refinements which are mentioned above or those which are mentioned below. It is therefore advantageously possible to carry out, as it were, "internal" synchronization in this at least one sub-area.

In order to achieve the object mentioned at the beginning, an elevator system is additionally proposed having a shaft system, a multiplicity of elevator cars which can move in the shaft system and having a control device for operating the elevator system, in particular for controlling the movement of the elevator cars in the shaft system, wherein the control device is configured to operate the elevator system according to a method according to the invention according to one or more of the refinements which are mentioned above and/or those which are mentioned below.

In particular there is provision here that the elevator system is a shuttle system. Such a shuttle system is, in particular, an elevator system by means of which users are moved to further passenger conveyor devices, for example further elevator systems or escalators. In such shuttle systems, in this context preferably only specific transfer floors, which have access to the further passenger conveyor devices, are traveled to. This means that the distance between adjacent stopping points can amount to, in particular, a plurality of floors here.

If the distances between such transfer floors are large, with the result that a relatively long travel time occurs for the movement from one transfer floor to the next transfer floor, for example a travel time of 10 seconds or more, according to a further advantageous refinement of the invention there is provision that in the elevator system the elevator cars are assigned to a first group and to a second group. In this context there is advantageously provision that the first group of elevator cars is located at a transfer stopping point, while the second group of elevator cars is moved. While the first group of elevator cars is accelerated from their transfer stopping points, the second group of elevator cars is advantageously decelerated.

If two circulating elevator systems are in operation one next to the other wherein the elevator systems serve the same floors in the shuttle mode, there is thus advantageously provision for the elevator system to be additionally synchronized in such a way that during the stationary time of the elevator cars of the one elevator system the elevator cars of the other elevator system are moved. This advantageously prevents a bunching effect between the circulating multi-car systems.

FIG. 1 illustrates an exemplary embodiment of an elevator system 1. The elevator system 1 is here in this exemplary embodiment what is referred to as a shuttle system by means of which users are moved, in particular in what are referred to as "high rise buildings" to further passenger conveyor devices, in particular further elevator systems and/or escalators. The elevator system 1 therefore only has a comparatively small number of floors 4 at which persons can get out or get in.

The elevator system 1 illustrated by way of example in FIG. 1 comprises a shaft system 2 with a first shaft 5 and a second shaft 6. These shafts 5, 6 do not have to be structurally separated shafts. In particular, the first shaft 5 and the second shaft 6 can each form areas of a common shaft. In other refinements of the elevator system according to the invention in particular more than one first shaft 5 and one second shaft 6 can also be provided.

The elevator system 1 illustrated in FIG. 1 additionally comprises a plurality of elevator cars 3 which can move in the shaft system 2. Moreover, the elevator system 1 illustrated in FIG. 1 has a transfer device 10 at each of its respective system shaft ends and in the central region of the shaft system 2. Elevator cars 3 can changeover between the first shaft 5 and the second shaft 6 by means of these transfer devices 10. In particular, in further advantageous refinement variants, a plurality of transfer devices are also provided between the ends of the shaft system 2 (not illustrated in FIG. 1).

Furthermore, the elevator system 1 which is shown in FIG. 1 comprises a control device (not illustrated explicitly in FIG. 1). This control device is designed to operate the elevator system 1. In particular, the control device is designed to control the movement of the elevator cars 3. The control of the elevator cars 3 is carried out here in such a way that the elevator cars 3 are moved separately from one another between floors 4 in a circulation operation, wherein the elevator cars 3 are moved exclusively upward in a first shaft 5, which is illustrated symbolically in FIG. 1 by means of the arrow 8, and exclusively downward in a second shaft 6, which is illustrated symbolically in FIG. 1 by the arrow 9. By means of the transfer devices 10, the elevator cars 3 are moved here from the first shaft 5 into the second shaft 6 at the upper end of the shaft system 2, or are moved from the second shaft 6 into the first shaft 5 at the lower end of the shaft system 2. By means of the further transfer device 10 in the central area of the shaft system 2, a changeover of elevator cars 3 between the shafts 5, 6 is advantageously made possible, without an elevator car 3 having completed an entire circulation movement through the shaft system 2. As a result, the control device of the elevator system 1 can advantageously react in a further improved fashion to temporary and/or locally higher transportation requirements of persons.

The control device of the elevator system 1 illustrated in FIG. 1 is additionally configured to define at least a number of shaft positions 7 which can be respectively moved to by the elevator cars 3 and which corresponds to the number of elevator cars 3. In this exemplary embodiment the stopping points at the floors 4 are defined as shaft positions. Then, the control device carries out synchronization of the movement of the elevator cars 3 with respect to these shaft positions 7, that is to say in this exemplary embodiment with respect to the stopping points at the floors 4. That is to say the further upward and/or downward movement of the elevator cars 3 is synchronized with respect to the defined shaft positions 7. In particular, if more elevators cars 3 are moved in the elevator system 2 than the elevator system 2 has stopping points, there is provision that further shaft positions are defined between the stopping points, with respect to which stopping points synchronization of the movement of the elevator cars 3 is then carried out in addition to the stopping points.

Since, in such elevator systems 2, the number of elevators cars 3 can, as shown in FIG. 1, be advantageously adapted as a function of demand, if the number of movable elevator cars 3 of the elevator system 2 exceeds the number of stopping points of the elevator system this is advantageously predefined as a predefined event. When this event occurs, the shaft positions, with respect to which the synchronization of the movement of the elevator cars 3 is carried out, is advantageously newly defined. If elevator cars 3 are removed from the elevator system 2, with the result that the number of stopping points of the elevator system is again equal to or larger than the number of movable elevator cars 3, this advantageously constitutes a further predefined event, which triggers a re-definition of the shaft position 7.

Further such predefined events which trigger a re-definition of the shaft position are, in particular, specific times of day at which an increased local transportation demand occurs. Such times of day are in office buildings, in particular, the start of the working time, that is to say when a large number of persons wish to be conveyed from the ground floor and/or from an underground garage into the higher floors, midday and the end of the working time, that is to say when a large number of persons wish to be conveyed from the higher floors to the ground floor or to the underground garage. In this context, elevator cars 3 are advantageously to be made available at the shortest possible time intervals. In this context, shaft positions are advantageously defined at predefined intervals starting from an "entry stopping point", in such a way that a safety distance is maintained between the elevator cars 3 and there are short time intervals between the departure of an elevator car from the "entry stopping point" and the movement of a further elevator car into this "entry stopping point". In particular, in this context the synchronization can be carried out in such a way that the departure of an elevator car from the "entry stopping point" and the "further movement" of the further elevator cars from the respective shaft position of this occur simultaneously with the respective next shaft position.

In order to synchronize the movement of the elevator cars, in the exemplary embodiment illustrated in FIG. 1 the control device logically assigns in each case one of the defined shaft positions 7 to one of the elevator cars 3 in each case. This is advantageously carried out in such a way that the respectively current position of the elevator cars in the respective shaft 5, 6 is defined as a shaft position. If all the elevator cars 3 stop at a stopping point on a floor 4, for example the stopping point at which the respective elevator car 3 is located is the shaft position 7 which is assigned to this elevator car 3. In a further method sequence, each elevator car 3 is then advantageously assigned that shaft position at which the elevator car 3 which is moving ahead of this elevator car 3 is still located, with the result that the next synchronization occurs, when considered for this elevator car, with respect to this newly defined shaft position. Therefore, at any time a shaft position of an elevator car is logically assigned, wherein, in particular after a synchronization process, the assignment advantageously occurs anew, in particular in such a way that another elevator car which is "moving behind" is then assigned to the shaft positons.

There is provision as an advantageous refinement variant of the elevator system 1 illustrated in FIG. 1 that, according to an inventive refinement of the method for operating the elevator system 1, the transfer devices 10 are each defined, during operation of the elevator system, for an elevator car 3, which is transferred by the transfer device 10, as a shaft position 7. For at least one of the elevator cars the synchronization is then carried out with respect to this transfer device 10.

According to a further refinement variant there is provision that the elevator system 1 is operated in such a way that a sub-area of the shaft system 2 in which a subset of the elevator cars 3, that is to say not all of the elevator cars 3 of the elevator system 1, is located, is excluded from the execution of the synchronization. The control device of the elevator system 1 is advantageously designed to perform corresponding control of the elevator system 1. For example, in this refinement variant a transfer device 10 can be designed as such as sub-area of the shaft system which is excluded from the execution of the synchronization. However, in particular a sub-area of the shaft system can also be excluded from the execution of the synchronization as a function of call requests. If, for example, a large number of call requests are present in a lower part of the building, but few call requests are present in an upper part of the building, with the result that only a few elevator cars 3 are moved in this upper part of the building with a large distance between them, which significantly exceeds the safety distance between elevator cars, this upper part of the building is thus advantageously excluded from the synchronization. Synchronization which is independent of the rest of the shaft system 2 is then advantageously carried out for this upper part of the building, that is to say the sub-area of the shaft system 2 which is allocated to this upper part of the building.

Figure 2:
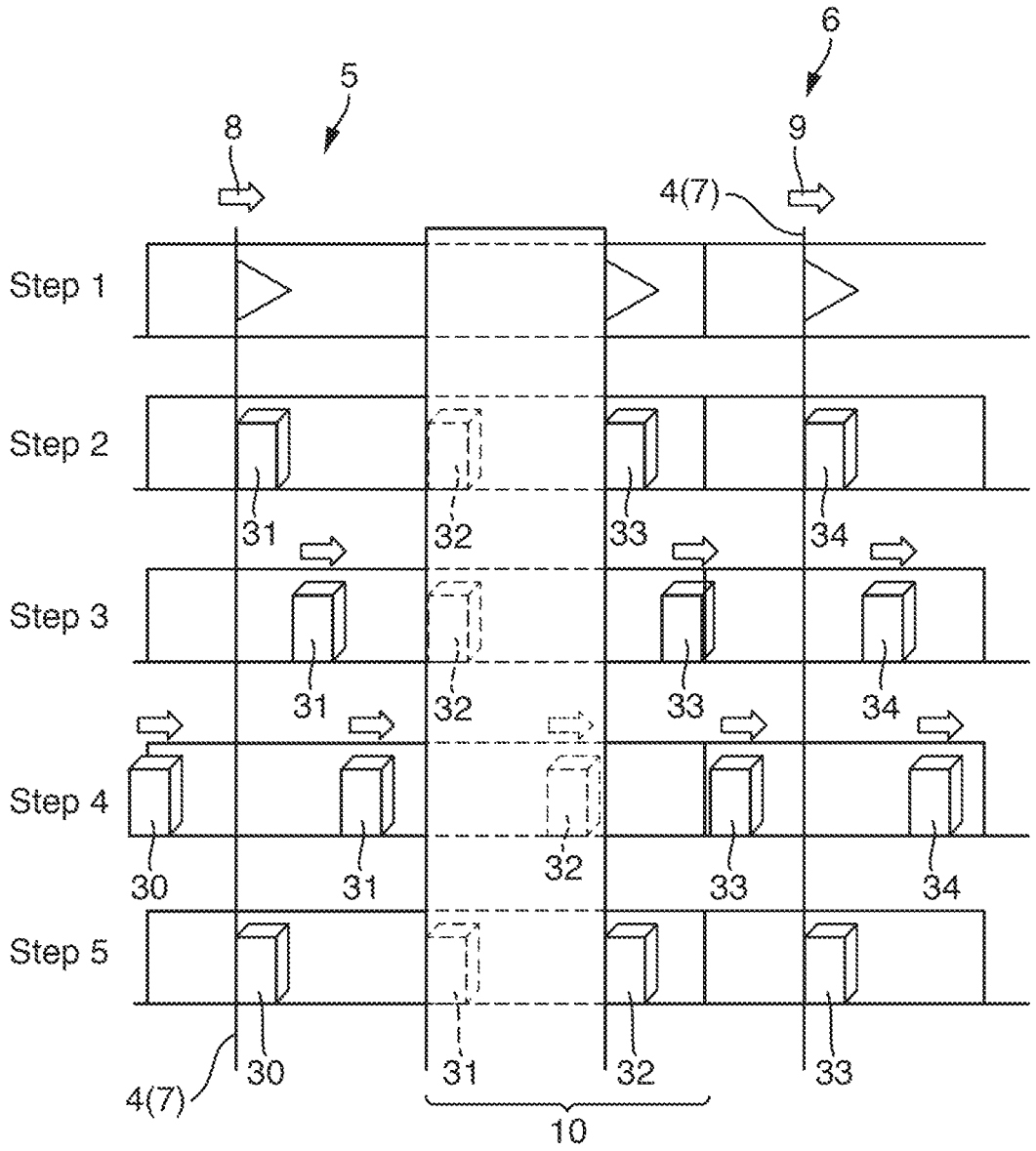
FIG. 2 is a simplified schematic view illustrating an example method for operating an elevator system.

An exemplary embodiment of a method according to the invention for operating an elevator system with a transfer device 10 is described in more detail with respect to FIG. 2. Shafts 5, 6 which actually run vertically are illustrated horizontally here for the sake of better illustration of the movement of the elevator cars 3, with the respectively same elevator system being illustrated at progressive times. That is to say the shaft 5 respectively illustrated to the left of the transfer device 10 in FIG. 2 is actually that shaft in which elevator cars 3 are moved upward, which is illustrated symbolically by the arrow 8. The shaft 6 which is respectively illustrated to the right of the transfer device 10 in FIG. 2 is actually that shaft in which elevator cars 3 are moved downward which is illustrated symbolically by the arrow 9. Floors 4 at which stopping points of the elevator system for the elevator cars 3 are located are illustrated symbolically by vertical dashes. In order to differentiate between the individual elevator cars, a further number is respectively added to the reference symbol "3", so that in FIG. 2 elevator cars 30, 31, 32, 33 and 34 are illustrated.

The elevator cars 30, 31, 32, 33 and 34 are moved separately from one another, that is to say, in particular, are not coupled to one another, between floors 4 of the elevator system in a circulation operation, in such a way that the elevator cars 3 are moved upward in the first shaft 5 and downward in the second shaft 6. In this context, the stopping points which can be moved to by the elevator cars 30, 31, 32, 33 and 34 in the floors 4 are defined as shaft positions 7. Synchronization of the movement of the elevator cars 30, 31, 32, 33 and 34 is then carried out with respect to these stopping points which are the defined shaft positions 7.

In the exemplary embodiment explained in relation to FIG. 2, there is provision here that the synchronization of the movement of the elevator cars 30, 31, 32, 33 and 34 is carried out with respect to the defined shaft positions 7, that is to say with respect to the stopping points, in such a way that all the elevator cars, that is to say all the elevator cars which are involved in the synchronization, leave the stopping points simultaneously. In this respect, this synchronization can be referred to as starting synchronization. In particular there is provision that the elevator cars 30, 31, 32, 33 and 34 are each moved here according to a travel curve, wherein in order to synchronize the movement of the elevator cars 30, 31, 32, 33 and 34, the respective travel curves are adapted taking into account the positions of the elevator cars 30, 31, 32, 33 and 34 in the respective shaft 5, 6. The transfer device 10 and elevator cars which are located in the transfer device 10 are excluded from the synchronization here.

In this context, operating parameters are advantageously detected with respect to each of the elevator cars 30, 31, 32, 33 and 34, and each of the elevator cars 30, 31, 32, 33 and 34 which are involved in the synchronization move at least taking into account the operating parameters detected with respect to the respective elevator car and taking into account the operating parameters detected with respect to the elevator car which travels ahead of this elevator car. In this context, in particular the current position, speed, acceleration and the respective waiting time at the respective stopping point of each elevator car are detected as operating parameters. The waiting times, that is to say stopping times of each elevator car, during which the respective elevator car is not moved, is predicted for each of the elevator cars and detected as one of the operating parameters. If a waiting time is predicted for the next stop of an elevator car which is short in comparison with that of other elevator cars, the arrival of an elevator car can be delayed by adapting the input values of the travel curve of this elevator car. This can occur while the elevator car is traveling to the stopping point, but also before the start of a travel operation at the stopping point. As a result of the relatively late arrival and the relatively short stopping time in comparison with the other elevator car, a synchronized start of the next travel operation occurs without additional waiting times.

FIG. 2 then illustrates, by way of example, at "step 2" how the elevator car 31 and the elevator car 34 each stop at a stopping point at one floor 4 as a defined shaft position 7. Since synchronization with the exiting of the stopping point is carried out, the elevator car 31 and the elevator car 34 depart from the respective stopping point simultaneously, as is illustrated under "step 3". The elevator cars 32, 33 which are located in the transfer device 10 are excluded from the synchronization here. At "step 4" it is now shown how an elevator car 30 moves into a stopping point as a defined shaft position 7, wherein this shaft position 7 is logically linked to this elevator car 30. The elevator car 31 moves into the transfer device 10, with the result that the latter is initially excluded from the further synchronization, as is also the elevator car 32 which is still located in the transfer device 10. On the other hand, the elevator car 33 has left the transfer device 10 and moves to a stopping point as a defined shaft position 7. This elevator car 33 is logically linked to this shaft position. The elevator car 34 is moved to a further stopping point (not illustrated in FIG. 2). In this exemplary embodiment, the elevator cars 30, 33 and 34 do not have to move simultaneously into the next stopping point. If a less long stopping time at the stopping point is predicted for one elevator car, for example the elevator car 30, than for another elevator car, for example the elevator car 33, there is advantageously provision that in order to avoid stopping times which are perceived as disruptively long by the conveyed persons, the travel operation of the elevator car 30 is delayed, with the result that it moves into the assigned stopping point later than the elevator car 33. At "step 5" it is shown how the elevator car 30 and the elevator car 33 are both located at the respective stopping point, so that again simultaneous exiting of these elevator cars 30, 33 from the stopping points can be implemented.

Three advantageous refinement variants of the synchronization according to a method according to the invention are explained in more detail below with reference to FIG. 3, FIG. 4 and FIG. 5. For the purpose of better clarity and of greater ease of understanding, only two successive elevator cars are taken into account in this context in FIG. 3 and FIG. 4.

Figure 3:
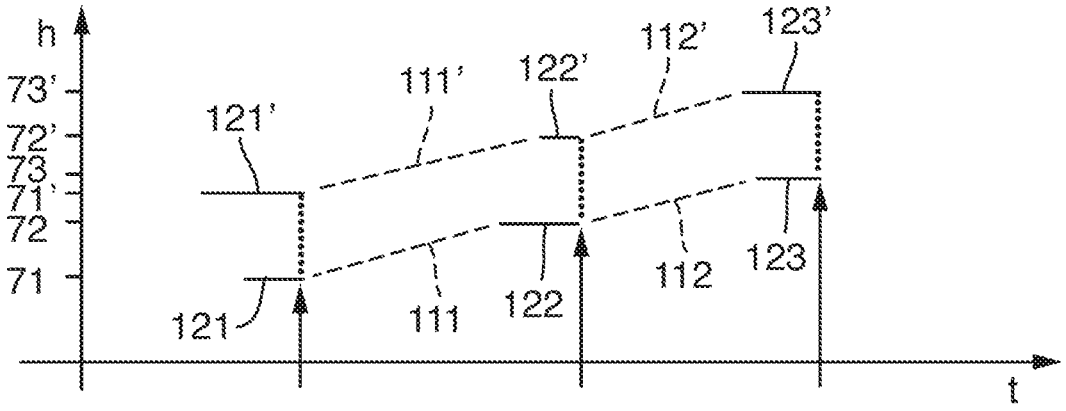
FIG. 3 is a simplified graphic illustrating another example method for operating an elevator system.
Figure 4:
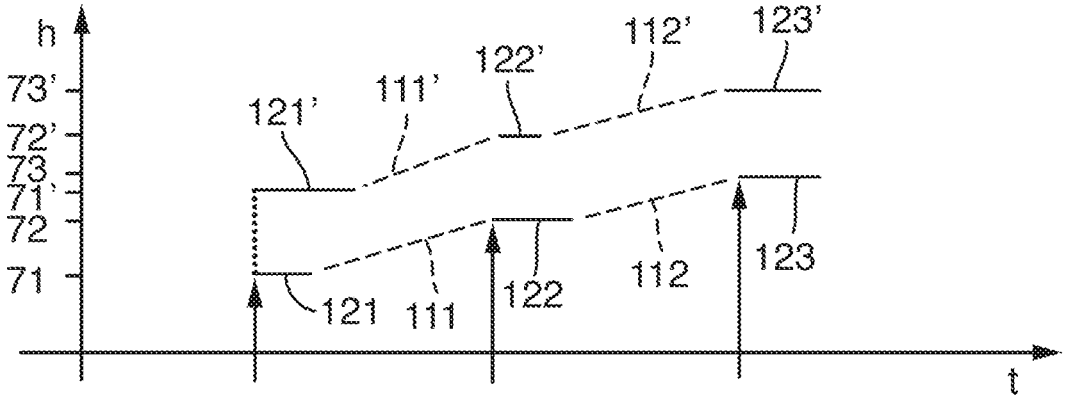
FIG. 4 is a simplified graphic illustrating still another example method for operating an elevator system.

Here, for example the upward movement of elevator cars, that is to say the reaching of a relatively large height (h) within a building is illustrated plotted against the time (t) in FIG. 3 and FIG. 4.

In the exemplary embodiment illustrated in FIG. 3, the shaft positions 71, 71', 72, 72', 73 and 73' are defined shaft positions according to the invention here. The synchronization of the movement of the elevator cars is carried out with respect to the defined shaft positions here, as explained in more detail below, in such a way that all the elevator cars leave the defined shaft positions simultaneously. In this exemplary embodiment, the defined shaft positions 71, 71', 72, 72', 73 and 73' are each stopping points. However, it is also basically possible to determine positions outside stopping points as defined shaft positions.

In the exemplary embodiment illustrated in FIG. 3, both elevator cars are here initially located at a stopping point 71 or 71'. The synchronization of the movement of the elevator cars is carried out with respect to the defined shaft positions 71, 71', 72, 72', 73 and 73' here in such a way that the elevator cars leave the defined shaft positions 71, 71', 72, 72', 73 and 73' simultaneously. That is to say even if one of the elevator cars could already move away because no persons are getting in or out, this elevator car is held at the respective shaft position until all the elevator cars which are involved in the synchronization process are ready to depart. This results in the stopping times 121 and 121' of the elevator cars which are of different lengths as illustrated in FIG. 3. If all the elevator cars are ready for departure, the elevator cars start together, as illustrated by way of example in FIG. 3. In order to prevent excessively long stopping times, there is provision as one advantageous refinement of the method that the doors to the cars are forcibly closed after a predefined maximum time interval. The expiry of this time interval is advantageously signaled to the persons here, in particular by means of a countdown display and/or a signaling device of a headlight type.

Before the arrival of the elevator cars at the respective next shaft positions, that is to say before the arrival at the shaft positions 72 or 72', in the exemplary embodiment illustrated in FIG. 3, particularly preferably already before the departure of the elevator cars from the respective stopping points 71 or 71', the stopping time for each elevator car at the respective shaft positions 72, 72' is already predicted. For this purpose, in particular stochastic methods are used. In this context, the respective current load in the respective elevator car and/or a learnt traffic flow and/or the number of waiting persons at the respective stopping point are advantageously taken into account. The number of waiting persons is determined, in particular, by means of the number of received destination calls and/or by means of camera systems.

The travel curves 111, 111', 112, 112' of the elevator cars are adapted as a function of the respectively predicted stopping times for the elevator cars, advantageously in such a way that unnecessarily long stopping times are very largely avoided. This is because long stopping times are felt to be disruptive by the passengers. Since in the exemplary embodiment illustrated in FIG. 3, the predicted stopping time 122' for the elevator car traveling ahead is shorter than the predicted stopping time 122 for the elevator car traveling behind, the respective travel curves 111' and 111 are adapted in such a way that the elevator car traveling ahead reaches the shaft position 72' later than the elevator car traveling behind reaches the shaft position 72. The travel curve 111 therefore has a steeper progression than the travel curve 111'.

With respect to the next stop at the shaft positions 73 or 73', the predicted stopping time 123' for the elevator car traveling ahead is longer than the predicted stopping time 123 for the following elevator car. The travel curve 112' of the elevator car traveling ahead is therefore adapted in such a way that it reaches the shaft position 73' more quickly than the following elevator car reaches the shaft position 73. The travel curve 112 therefore has a flatter progression than the travel curve 112'. In contrast to what is illustrated in the exemplary embodiment shown in FIG. 3, the travel curve does not have to have a linear progression. In particular there is provision that the travel curves can be adapted to changed operating parameters. Such adaptation can occur, in particular, if further destination calls are detected during the movement of the elevator cars, and the anticipated stopping time of one or more elevator cars therefore changes. By virtue of the fact that the elevator cars each leave the defined shaft positions 71 and 71' or 72 and 72' or 73 and 73' simultaneously, "running up" of the elevator cars against one another and therefore a bunching effect is advantageously prevented. In addition, a safety distance between the elevator cars is advantageously maintained in an improved fashion.

In the exemplary embodiment illustrated in FIG. 4, movement of the elevator cars is synchronized with respect to the defined shaft positions 71, 71', 72, 72', 73 and 73', in such a way that the elevator cars which are involved in the synchronization reach the defined shaft positions simultaneously. As in the exemplary embodiment explained in relation to FIG. 3, in the exemplary embodiment explained in relation to FIG. 4 there is provision that stopping points are each defined as the defined shaft positions 71, 71', 72, 72', 73 and 73'. In this exemplary embodiment, the elevator cars are each logically linked to the defined shaft positions. In the illustration in FIG. 4, for example the elevator car traveling ahead is therefore firstly logically linked to the shaft position 71', then to the shaft position 72' and then to the shaft position 73'. Correspondingly, the following elevator car is logically linked to the shaft position 71, then to the shaft position 72 and then to the shaft position 73. That is to say that in each case the defined shaft positon which is next to be reached by an elevator car in the direction of travel of an elevator car is logically assigned to the respective elevator car. The synchronization of the movement of the elevator cars is then carried out in each case with respect to the respective shaft positions which are logically linked to the elevator cars.

Anticipated stopping times 121, 121', 122, 122', 123 and 123' of the elevator cars are advantageously predicted, as explained in relation to FIG. 3. The elevator cars are each moved according to individual travel curves 111, 111', 112 and 112'. In this context, in order to synchronize the movement of the elevator cars the respective travel curves 111, 111', 112 and 112' of the elevator cars are adapted taking into account current operating parameters, in particular taking into account the positions of the elevator cars in the respective shaft.

As illustrated by way of example in FIG. 4, the shaft positions 71 and 71' are reached simultaneously by the elevator cars. As soon as a departure of the respective elevator car from the respective stopping point is possible, in particular when no more persons are getting in or out, the elevator cars leave the respective stopping points. This results in different stopping times 121, 121', 122, 122', 123 and 123' of the elevator cars. So that the elevator cars nevertheless reach the next stopping point as the next defined shaft position simultaneously, the travel curves 111, 111', 112 and 112' of the elevator cars are correspondingly adapted. Since the elevator car traveling ahead, for example, leaves the shaft position 71' later than the elevator car traveling behind leaves the shaft position 71, the elevator car traveling ahead will move with a higher speed than the following elevator car. The travel curve 111' is therefore steeper than the travel curve 111. Correspondingly, the travel curve 112 of the elevator car traveling behind is adapted in such a way that this elevator car is moved more slowly than the elevator car traveling ahead. The travel curve 112' is therefore flatter than the travel curve 112.

During the operation of an elevator system explained in relation to FIG. 4, the travel curves of the elevator cars are changed, in particular by adapting the input values of the travel curves, in such a way that the elevator cars arrive simultaneously at their next stopping point. Elevator cars can then start the travel operation to the next stopping point individually after their respective stopping time at the respective defined shaft position. The common arrival time at the next stopping point is advantageously used here to determine suitable input parameters for the travel curves for the further travel of the elevator cars. In this context, the anticipated travel times and/or anticipated residual travel times of the individual elevator cars are advantageously taken into account. An advantage of this arrival synchronization is that it is not necessary to wait passively, since only the travel curves of the elevator cars are adapted.

The synchronization advantageously always takes into account that predefined safety intervals between the elevator cars are maintained. To do this, operating parameters are advantageously detected with respect to each of the elevator cars, and each of the elevator cars moves at least taking into account the operating parameters detected with respect to this elevator car, and taking into account the operating parameters detected with respect to the elevator car traveling ahead of this elevator car.

Figure 5:
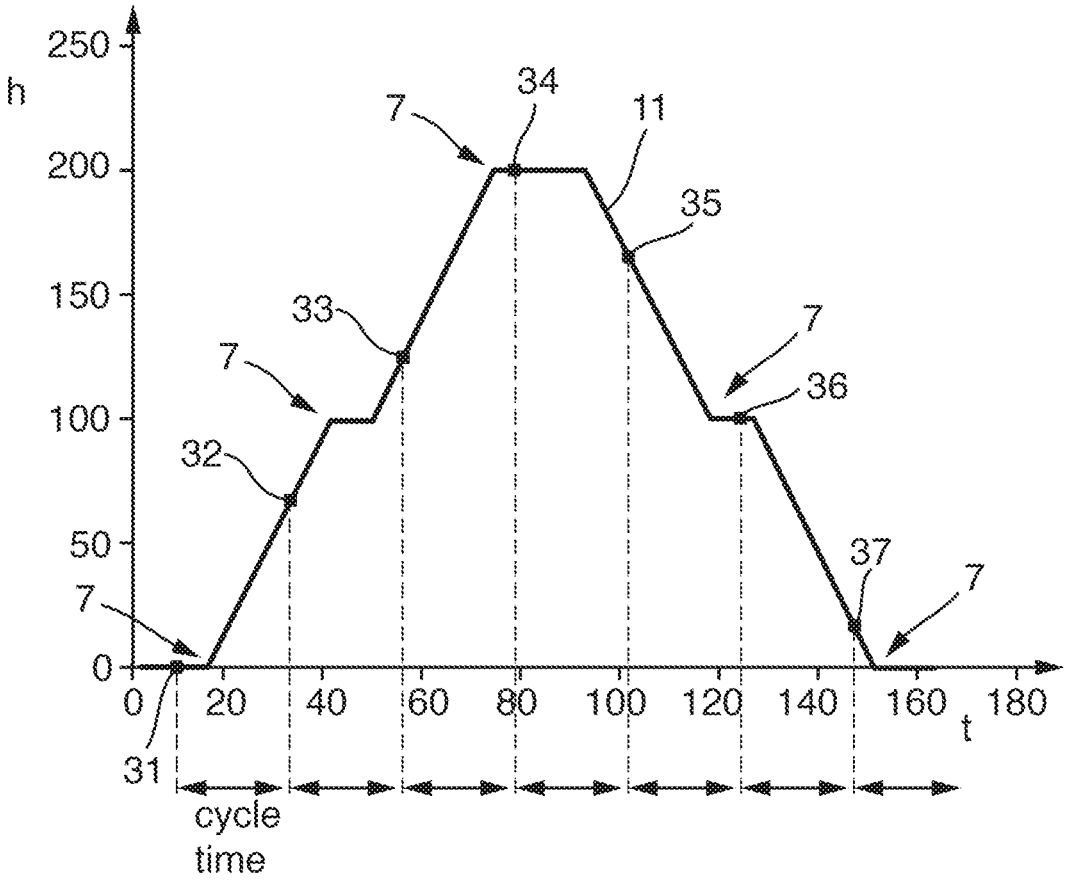
FIG. 5 is a simplified graphic illustrating yet another example method for operating an elevator system.

FIG. 5 illustrates by way of example elevator cars 31, 32, 33, 34, 35, 36 and 37 at different positions (h) in the shaft system at times (t). This synchronization of the movement of the elevator cars 31, 32, 33, 34, 35, 36 and 37 is advantageously carried out here in such a way that a time interval, referred to in FIG. 5 as "cycle time" between successive elevator cars is maintained. The synchronization of the elevator cars 31, 32, 33, 34, 35, 36 and 37 is carried out with respect to the defined shaft positions 7 in this exemplary embodiment.

In the exemplary embodiment illustrated in FIG. 5, the synchronization of the movement of the elevator cars 31, 32, 33, 34, 35, 36 and 37 is carried out with respect to the defined shaft positions 7 in such a way that, for an operating time period of the elevator system, for example the morning operation of the elevator system, the elevator cars 31, 32, 33, 34, 35, 36 and 37 are each at the respective shaft position 7 at a predefined time, in particular reach or leave the respective defined shaft position 7 at a predefined time. This results, as it were, in a timetable for each individual elevator car of the elevator cars 31, 32, 33, 34, 35, 36 and 37. This timetable is advantageously adapted here when necessary within the scope of the synchronization. Such adaptation of the timetable within the scope of the synchronization is positioned here after the adaptation of travel curves of the elevator cars 31, 32, 33, 34, 35, 36 and 37. That is to say the timetable is advantageously adapted here only if adaptation of the travel curves alone is not sufficient to carry out the synchronization.

In particular, the illustration in FIG. 5 can therefore also be considered to be a timetable for an individual elevator car, wherein the reference numbers 31, 32, 33, 34, 35, 36 and 37 denote in this case an individual elevator car at specific positions h in the shaft system at different times. In this context, there can be provision, for example, that the reference number 31 denotes the elevator car at the time 09:20:00 hours, the reference number 32 denotes the elevator car at the time 09:20:20 hours, the reference number 33 denotes the elevator car at the time 09:20:40 hours, the reference number 34 denotes the elevator car at the time 09:21:00 hours, the reference number 35 denotes the elevator car at the time 09:21:20 hours, the reference number 36 denotes the elevator car at the time 09:21:40 hours, and the reference number 37 denotes the elevator car at the time 09:22:00 hours. Synchronization of the movement of the elevator cars is carried out here with respect to the defined shaft positions 7, while the further movement of the elevator car is delayed by stopping the elevator cars.

The exemplary embodiments which are illustrated in the figures and explained in relation thereto serve to explain the invention and are not limiting for said invention.

LIST OF REFERENCE SYMBOLS

1 Elevator system
2 Shaft system
3 Elevator car
31 Elevator car
32 Elevator car
33 Elevator car
34 Elevator car
36 Elevator car
37 Elevator car
4 Floor
5 First shaft
6 Second shaft
7 Shaft position
71 Shaft position
71' Shaft position
72 Shaft position
72' Shaft position
73 Shaft position
73' Shaft position

8 Arrow for symbolic illustration of the upward travel operation
9 Arrow for symbolic illustration of the downward travel operation
10 Transfer device
11 Travel curve
111 Travel curve of an elevator car
111' Travel curve of an elevator car
112 Travel curve of an elevator car
112' Travel curve of an elevator car
121 Stopping time of an elevator car
121' Stopping time of an elevator car
122 Stopping time of an elevator car
122' Stopping time of an elevator car
123 Stopping time of an elevator car
123' Stopping time of an elevator car
h Position in shaft system
t Time

What is claimed is:

1. A method for operating an elevator system that includes a shaft system and elevator cars that are moved separately from one another between floors in a circulation operation, the method comprising:

moving the elevator cars upward in a first shaft;

moving the elevator cars downward in a second shaft; and synchronizing movement of the elevator cars with respect to defined shaft positions that the elevator cars are configured to adopt by operating the elevator cars at the defined shaft positions in a same operating state, wherein a quantity of the defined shaft positions is equal to or greater than a quantity of the elevator cars.

2. The method of claim 1 further comprising defining the defined shaft positions once or after predefined events.

3. The method of claim 1 comprising moving each of the elevator cars according to a travel curve, wherein to synchronize the movement of the elevator cars the travel curve for each elevator car is adapted to account for positions of the elevator cars in the same shaft.

4. The method of claim 1 comprising defining stopping points of the elevator system as the defined shaft positions.

5. The method of claim 1 further comprising logically assigning one of the defined shaft positions to one of the elevator cars in each case.

6. The method of claim 5 wherein in each case the defined shaft position that is next to be reached in a direction of travel of the one of the elevator cars is logically assigned to the one of the elevator cars.

7. The method of claim 1 comprising defining at defined time intervals in each case current positions of the elevator cars in the first shaft or second shaft as the defined shaft positions.

8. The method of claim 1 wherein the synchronization of the movement of the elevator cars is performed with respect to the defined shaft positions such that the elevator cars reach the defined shaft positions simultaneously.

9. The method of claim 1 wherein the synchronization of the movement of the elevator cars is performed with respect to the defined shaft positions such that the elevator cars leave the defined shaft positions simultaneously.

10. The method of claim 1 wherein the synchronization of the movement of the elevator cars is performed with respect to the defined shaft positions such that a duration is predefined in each case, wherein within the first shaft or within the second shaft the elevator cars do not reach the predefined shaft positions of the elevator cars traveling ahead until after the duration expires.

11. The method of claim 1 wherein the synchronization of the movement of the elevator cars is performed with respect to the defined shaft positions such that for an operating time period of the elevator system the elevator cars each reach the respective defined shaft positions at a predefined time.

12. The method of claim 1 wherein the synchronization of the movement of the elevator cars is performed with respect to the defined shaft positions such that for an operating time period of the elevator system the elevator cars each leave the respective defined shaft positions at a predefined time.

13. The method of claim 1 wherein the synchronization of the movement of the elevator cars is performed with respect to the defined shaft positions such that in each case a duration is predefined for an operating time period of the elevator system, wherein in the first shaft or the second shaft the elevator cars do not reach the predefined shaft position of the elevator car that is respectively traveling ahead until after the duration expires.

14. The method of claim 1 further comprising:

acquiring operating parameters with respect to each of the elevator cars; and moving each of the elevator cars based on its respective operating parameters and based on the respective operating parameters of the elevator car traveling ahead.

15. The method of claim 14 further comprising predicting stopping times during which each of the elevator cars will not move, wherein the stopping times are one of the operating parameters.

16. The method of claim 1 wherein the elevator system includes a transfer device for transferring elevator cars between the first and second shafts, wherein the transfer device is configured as one of the defined shaft positions for one of the elevator cars that is transferred by the transfer device.

17. The method of claim 1 wherein a sub-area of the shaft system in which a subset of the elevator cars is located is excluded from the synchronization.

18. The method of claim 17 further comprising synchronizing movement of the elevator cars in the sub-area of the shaft system independent of the synchronization that occurs in the first and second shafts.

19. A method for operating an elevator system that includes a shaft system and elevator cars that are moved separately from one another between floors in a circulation operation, the method comprising:

moving the elevator cars upward in a first shaft;

moving the elevator cars downward in a second shaft;

synchronizing movement of the elevator cars with respect to defined shaft positions that the elevator cars are configured to adopt, wherein a quantity of the defined shaft positions is equal to or greater than a quantity of the elevator cars; and moving each of the elevator cars according to a travel curve, wherein to synchronize the movement of the elevator cars the travel curve for each elevator car is adapted to account for positions of the elevator cars in the same shaft.

20. A method for operating an elevator system that includes a shaft system and elevator cars that are moved separately from one another between floors in a circulation operation, the method comprising:

moving the elevator cars upward in a first shaft;

moving the elevator cars downward in a second shaft;

synchronizing movement of the elevator cars with respect to defined shaft positions that the elevator cars are configured to adopt, wherein a quantity of the defined shaft positions is equal to or greater than a quantity of the elevator cars; and logically assigning one of the defined shaft positions to one of the elevator cars in each case.

* * * * *